US005377726A

United States Patent [19]

Clüsserath

[11] Patent Number: 5,377,726

[45] Date of Patent: Jan. 3, 1995

[54] ARRANGEMENT FOR FILLING BOTTLES OR SIMILAR CONTAINERS

[75] Inventor: Ludwig Clüsserath, Bad Kreuznach, Germany

[73] Assignee: Seitz Enzinger Noll Maschinenbau Aktiengesellschaft, Mannheim, Germany

[21] Appl. No.: 99,602

[22] Filed: Jul. 30, 1993

[30] Foreign Application Priority Data

Aug. 1, 1992 [DE] Germany ..... 4225476

[51] Int. Cl.[6] ..... B65B 31/00

[52] U.S. Cl. ..... 141/39; 141/47; 141/49; 141/57; 141/261

[58] Field of Search ..... 141/6, 39, 47, 48, 49, 141/50, 51, 52, 53, 54, 57, 58, 261, 92

[56] References Cited

U.S. PATENT DOCUMENTS

| | | | |
|---|---|---|---|
| 3,886,982 | 6/1975 | Uth et al. | 141/39 |
| 4,360,045 | 11/1982 | Ahlers | 141/39 |
| 4,949,764 | 8/1990 | Clüsserath | 141/6 |
| 4,976,295 | 12/1990 | Clüsserath | 141/6 |
| 5,016,684 | 5/1991 | Clüsserath | 141/6 |
| 5,031,673 | 7/1991 | Clüsserath | 141/6 |

FOREIGN PATENT DOCUMENTS 0291971 11/1988 European Pat. Off. .

*Primary Examiner*—Henry J. Recla
*Assistant Examiner*—Steven O. Douglas
*Attorney, Agent, or Firm*—Robert W. Becker & Associates

[57] ABSTRACT

An arrangement for filling bottles under counterpressure and comprising at least one filling element relative to which a respective container is sealed during a filling process. The arrangement also has at least one gas channel that communicates with the interior of the container that is to be filled. Gas can be supplied in a controlled manner to the interior of the container from a chamber via the gas channel, and return gas displaced from the container during a filling process can be withdrawn to the chamber via the gas channel and at least one gas path. This gas path has an individually controllable control valve, and in series therewith a device that automatically controls the effective flow cross-section of the gas path in such a way that this flow cross-section is smaller in one direction of flow than in another, opposite direction of flow.

20 Claims, 2 Drawing Sheets

ARRANGEMENT FOR FILLING BOTTLES OR SIMILAR CONTAINERS

BACKGROUND OF THE INVENTION

The present invention relates to an arrangement for filling bottles or similar containers with a liquid filling material under counterpressure.

An arrangement of this general type is disclosed in the filling machine of U.S. Pat. No. 5,016,684. With this known filling machine, each filling element that is provided on a rotating rotor in addition to being provided with a slide disk control means that cooperates with external control elements that do not move along with the rotor and are thus inherently controlled during rotation of the rotor, is also provided with a control valve that can be activated individually and via which a gas path that serves for withdrawing return gas can be individually controlled by an electrical control device. All of the gas flows that are necessary for the known filling machine during the filling process are controlled by the slide disk control means and the control valves, and in particular especially the supply of an inert gas for pre pressurizing the respective bottle as well as the withdrawal of the return gas via the gas path, with this return gas being displaced from the interior of the bottle during the filling process by the filling material that is flowing into the bottle. With the known filling machine, return gas is also used for a partial pressurization and possibly also for a preliminary rinsing of the bottles that precedes this partial pressurization, and in particular via a connection that is provided in each filling element in addition to the gas path and that is controlled by the slide disk control means.

It is an object of the present invention to provide an arrangement that has a more straightforward construction with less outlay for control means, yet allows an optimum control of the gas flows that are necessary at least during pressurization and filling.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
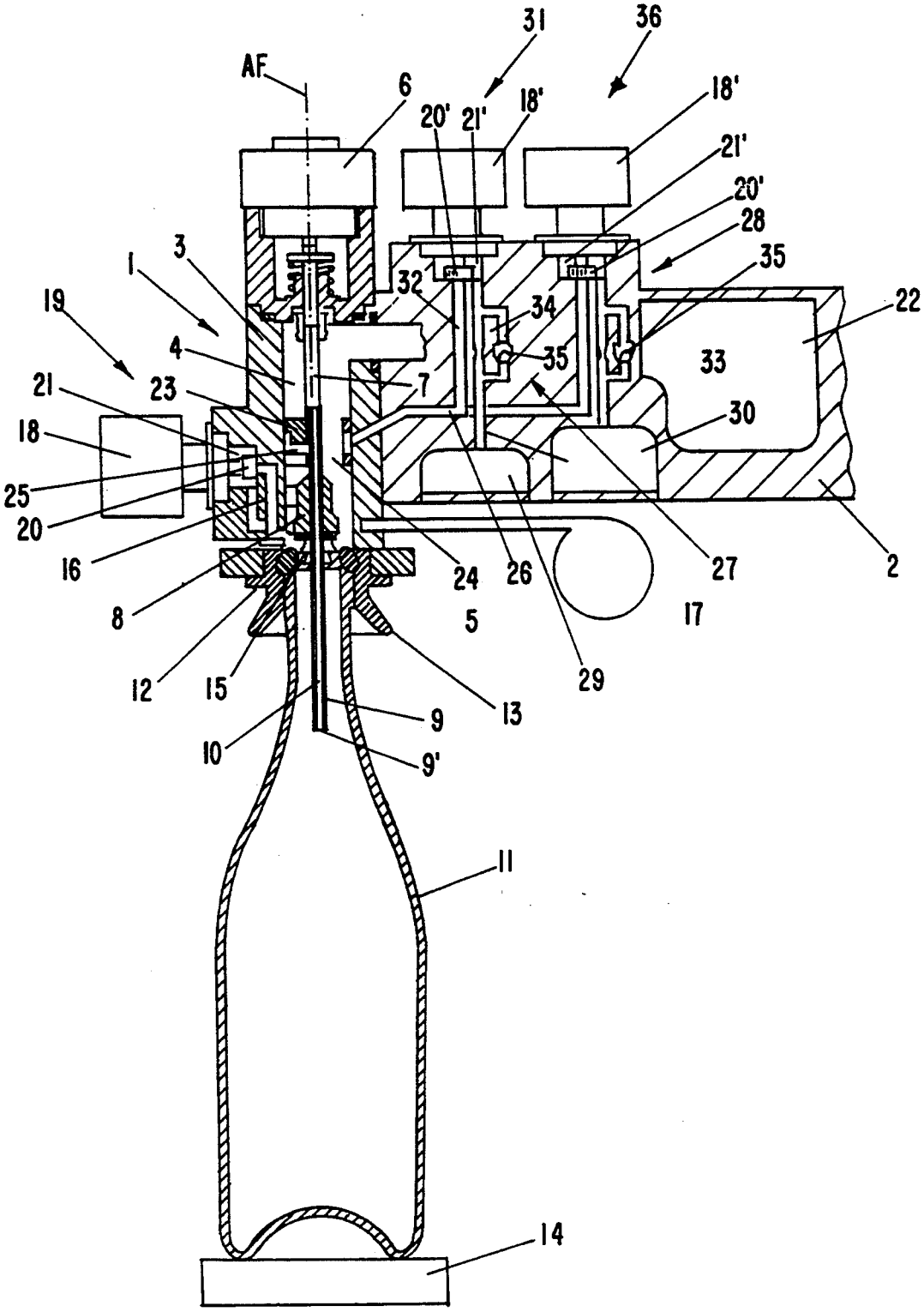
FIG. 1 is a simplified cross-sectional view of a filling element together with the rotor of a filling machine for a first exemplary embodiment of the present invention.

The arrangement of the present invention comprises: At least one filling element that is provided with a controlled liquid flow valve, whereby during a filling process a container that has been pressurized with gas is sealed relative to the filling element; at least one gas channel that communicates with an interior of the bottle for supplying gas thereto in a controlled manner from chamber means, and for withdrawing to said chamber means return gas that is displaced from the bottle during a filling process; and at least one gas path disposed between the gas channel and the chamber means, whereby a first channel portion of the at least one gas path is provided, in a series arrangement, with means for determining an effective flow cross-section, and with an individually activatable control valve means, whereby the means for determining an effective flow cross-section automatically controls the same such that for the return gas, which flows through the gas path in a first direction, the flow cross-section is smaller than for the gas, which flows through the gas path in a second, opposite direction.

It should be noted that in the context of the present invention, the "gas" is preferably a pre pressurizing or pressurizing gas, and possibly also a rinsing gas, and is preferably an inert gas.

With the arrangement of the present invention, it is possible, while using only a single control valve, to utilize a single chamber that contains inert gas under pressure, at least for a partial pressurization as well as possibly also for a preceding rinsing of the at least one container with the inert gas (for example $CO_2$ gas), as well as at the same time also for receiving return gas that is displaced from the container during the subsequent filling phase. The means for automatically controlling the effective flow cross-section of the gas path is preferably formed by a parallel arrangement of at least one check valve and at least one nozzle means or flow control device, with this parallel arrangement being disposed in series with the control valve means. This means for automatically controlling the effective flow cross-section of the gas path ensures that during pressurization, and possibly also during a preceding rinsing, a sufficient quantity of the inert gas is supplied from the chamber to the container; in other words, a short pressurizing time and possibly also a short rinsing time are achieved. As a result of the reduced and precisely calibrated flow cross-section for the return gas, it is furthermore possible to maintain the desired filling speed in a reproducible manner.

The at least one gas path is preferably connected with a pre pressure-relief chamber or return gas chamber in which a pressure that is well below a filling pressure is then adjusted or set. In addition to this gas path that is connected with the pre pressure-relief chamber or return gas chamber, it is also possible to provide a second gas path that also has the means for automatically controlling the flow cross-section and that is connected to a chamber that is embodied as a pressurized gas chamber. This chamber is either a chamber that is separate from the filling material or is a space that is formed above the filling material in a tank that is only partially filled with the filling material.

Instead of this second gas path that is connected to the chamber for pressurized gas, it is also possible to provide a conduit that does not have the means for automatically controlling the flow cross-section; in this conduit there is then again preferably disposed an individually controllable control valve means, with the conduit, just like the second gas path, also communicating with the interior of the container that is to be filled.

With the inventive arrangement, it is possible to eliminate the complicated slide disk controls for the filling elements of a filling machine, thereby resulting in a significant simplification of the construction of a filling machine and its filling elements. This is possible in particular by using a further valve that controls a pressure-relief channel and that is either an individually controllable control valve or a valve that is automatically controlled by external control elements of the filling machine during rotation of the rotor.

Within the context of the present invention, the individually controllable control elements are control valves that each have their own actuating means, which, for example, can be an electrical, but preferably pneumatic, actuating means, and which can thus be individually activated by a control device. The control valves are preferably embodied in such a way that their closed position corresponds to the non-activated state. If a malfunction occurs in the electrical control device that activates the control valves, and/or in the connections between this control device and the control valves, the latter thus remain in their closed position or change to this position, thereby significantly improving the operational reliability of the filling machine.

A further advantage of the present invention is that the at least one gas path, which has the means for automatically controlling the effective flow cross-section, can have a cleaning medium or cleaning fluid optimally flow through in that flow direction in which this control means has the greater flow cross-section; in other words, a CIP (cleaning in place) cleaning is possible with a large flow cross-section.

Further specific features of the present invention will be described in detail subsequently.

DESCRIPTION OF PREFERRED EMBODIMENTS

Referring now to the drawings in detail, FIG. 1 shows a filling element 1 that has no filling tube. A number of such filling elements 1 are disposed about the periphery of a rotor that rotates about a vertical axis; such a rotor is indicated only schematically in FIG. 1 by a rotor portion 2.

The filling element 1 has a housing 3 in which is provided a liquid channel 4 that in turn is provided with a liquid flow valve 5.

Provided at the top of the housing 3 is an actuating means 6 for effecting a controlled opening and closing of the liquid flow valve 5. The actuating means 6 acts upon the valve body 8 of the liquid flow valve via a push member 7 that is coaxial with a vertical axis AF of the filling element 1. The push member 7 continues as a tubular member 9, the axis of which is coaxial with the axis AF. The tubular member 9 concentrically surrounds a rod-like probe 10 that determines a filling height; the tubular member 9 surrounds the probe 10 in such a way that an annular gas channel (return gas channel) is formed between the outer surface of the probe 10 and the inner surface of the tubular member 9, with the gas channel opening out at the bottom end of the tubular member 9 via an opening 9'.

FIG. 1 shows a bottle 11 that is to be filled and that is brought into a sealed position relative to the filling element via the cooperation of an annular sealing means 12, a centering bell 13, and a bottle support 14 that raises the bottle 11. The bottom ends of the tubular member 9 and of the probe 10 extend into the interior of the bottle 11.

Below the valve body 8, the liquid channel 4 forms a discharge opening 15 that concentrically surrounds the tubular member 9 and via which, when the liquid flow valve 5 is opened, the liquid filling material flows to the bottle 11 that is to be filled. Also opening out in the vicinity of the discharge opening 15 is a pressure-relief channel 16 that is provided in the housing 3 and that is connected to a residual gas chamber 17 that is provided on the rotor portion 2 in common for all of the filling elements 1 of the filling machine. Provided in the pressure-relief channel 16 is a valve 19 that can be individually controlled by an actuating means 18. The valve 19 is embodied as a seating valve and essentially comprises a valve body 20 that is controlled by the actuating means 18. The valve body 20 is disposed in a cylindrical valve chamber 21 that is provided in the housing 3 and through which extends the pressure-relief channel 16. In the closed state of the valve 19, i.e. when the actuating means 18 is not activated, the valve body 20 rests against an annular surface at the base of the cylindrical valve chamber 21; this annular surface surrounds an opening or mouth of the pressure-relief channel 16.

The upper portion of the liquid channel 4 above the valve body 8 communicates with an annular chamber 22 for the liquid filling material that is provided on the rotor portion 2 in common for all of the filling elements 1 of the filling machine.

As can be seen from FIG. 1, seated upon the tubular member 9 of the valve body 8, and above the latter, is a distribution means 23 that has openings 24, distributed about the axis AF, for the liquid filling material; the distribution means 23 also has a channel 25 that extends radially relative to the axis AF. Radially inwardly, the channel 25 is connected to the upper, closed end of the return gas channel that is formed between the inner surface of the tubular member 9 and the outer surface of the probe 10. Radially outwardly, the channel 25 is connected with two controlled gas paths 27 and 28 via a channel 26 that is formed partially in the housing 3 and partially in the rotor portion 2. The gas path 27 leads to a pre pressure-relief chamber 29 that is provided in the rotor portion 2, while the gas path 28 leads to a pressurized gas chamber 30. The channels 25 and 26, together with the return gas channel that is provided in the tubular member 9, form a gas channel that communicates with the interior of the bottle via the opening 9'.

A single pre pressure-relief chamber 29 and a single pressurized gas chamber 30 are provided in the rotor portion 2 for all of the filling elements 1 of the filling machine. The two gas paths 27 and 28 have in principle the same configuration. The gas path 27 has a control valve means 31 that is constructed in the same manner as is the control valve 19, in other words, it has an actuating means 18' that corresponds to the actuating means 18, a valve body 20' that corresponds to the valve body 20, and a valve chamber 21' that corresponds to the valve chamber 21; the valve means 31 does differ in that the valve chamber 21' is provided in the rotor portion 2, and in particular in the region of an upper, horizontal surface thereof.

The upper end of a channel portion 32 opens centrally into the base of the valve chamber 21'; the lower end of the canal portion 32 opens into the channel 26. The valve body 20' cooperates with an annular surface that surrounds the opening of the channel portion 32.

Radially offset from this annular surface or from the valve body 20', a channel portion 33 opens out into the base of the valve chamber 21' of the valve means 31. Provided in this channel portion 33, which leads to the pre pressure-relief chamber 29, are a flow control device or nozzle 34 and parallel thereto a check or ball valve 35. The valve 35 is oriented in such a way that when the control valve means 31 is opened, a gas stream can flow out of the pre pressure-relief chamber 29 and over the gas path 27 to the channel 26, while a gas stream in the opposite direction is prevented. The ball of the check valve 35 is provided in a vertically extending section of the channel portion 33 so that the check valve is already held in the closed state by the weight of the ball.

The controllable gas path 28 has a configuration identical to that of the controllable gas path 27. The control valve means of the gas path 28 corresponds to the control valve means 31 and is designated by the reference numeral 36. In other respects, the same reference numerals have been used for the gas path 28 as were used for the gas path 27, with the channel portion 33 of the gas path 28 being connected to the pressurized gas chamber 30.

In the illustrated embodiment, the actuating means 18 and 18', and preferably also the actuating means 6, are each pneumatic actuating means that are controlled by electropneumatic control valves of an electrical control means of the filling machine. With the configuration that has been described, a straightforward construction is provided, especially without a slide disk control mechanism, whereby each filling element 1 can be individually and optimally controlled for the individual functions during a filling process. With the embodiment that has been described, the following process steps are, for example, possible, whereby in the individual process steps only those of the respective valves 5, 18, 31 and 36 are opened where this is specifically stated:

1. Preliminary Rinsing of the Bottle 11

For this step, the bottle 11 is in a sealed position relative to the filling element 1. With the valve means 19 and 31 open, $CO_2$ gas can flow into the bottle 11 via the gas path 27 and the opening 9'. The $CO_2$ gas displaces the air that is present in the bottle 11 via the pressure-relief channel 16 into the residual gas chamber 17, which communicates with the atmosphere in a suitable manner.

2. Partial Pressurization with $CO_2$ Gas

After a prescribed rinsing time has elapsed, the control valve 19 is closed. The gas path 27, in other words the control valve means 31, remains open, so that a partial pressurization of the bottle 11 from the pre pressure-relief chamber 29 is effected.

3. Remaining Pressurization with $CO_2$ Gas

After a prescribed period of time, the valve means 31 is closed and the valve means 36 is opened, so that $CO_2$ gas then flows via the gas path 28 out of the pressurized chamber 30 and into the bottle 11, thereby pressurizing the interior of the bottle 11 to a pressure that is somewhat less than the pressure in the annular chamber 22. The pressure difference is, for example, approximately 0.3 bar.

4. Filling

After the pressurization, the valve means 36 is closed. By means of the actuating means 6, the liquid flow valve 5 is opened, and immediately after the opening of the liquid flow valve the valve means 31 is opened, so that the liquid filling material flows into the bottle 11 and the $CO_2$ gas that is thereby displaced out of the bottle 11 can flow via the gas path 27 to the pre pressure-relief chamber 29. Due to the direction of flow of the $CO_2$ gas, and also due to the difference between the pressure in the interior of the bottle 11 and the pressure in the pre pressure-relief chamber 29, the check valve 35 remains closed, in other words, the effective cross-sectional area of the gas path 27 is determined exclusively by the flow control device or nozzle means 34. This ensures that during the filling process the filling material flows to the bottle 11 in a gentle manner and at a slow rate.

5. Rapid Filling

After conclusion of the filling time, with the valve means 31 still open the valve means 36 is also opened, so that now for a rapid phase the $CO_2$ gas can be displaced out of the bottle 11 not only via the gas path 27 into the pre pressure-relief chamber 29 but also via the gas path 28 into the pressurized gas chamber 30. In so doing, due to the pressure difference that exists and the direction of flow, the check valves 35 in both gas paths remain closed, and the filling rate achieved during the rapid filling phase is thus determined by the cross-sectional areas of the two flow control devices or nozzle means 34.

6. Retarded and Corrective Filling

For this purpose, with the valve means 36 still open the valve means 31 is closed, so that the displaced $CO_2$ gas can flow into the pressurized gas chamber 30 exclusively via the gas path 28 and the flow control device or nozzle means 34 thereof.

7. Conclusion of Filling, Pre pressure-Relief and Calming Down

After the probe 10 has been covered, perhaps after a corrective time has elapsed, the liquid flow valve 5 is closed. With the valve means 36 closed, the valve means 31 is opened, so that a pre pressure-relief or pressure equalization with the pre pressure-relief chamber 29 takes place via the gas path 27. Due to the pressure difference that exists, the check valve 35 in the gas path 27 remains closed during this phase, so that the pressure equalization with the pre pressure-relief chamber 29 is effected relatively slowly and gently via the nozzle means 34.

8. Residual Pressure Relief

After conclusion of the calming-down phase, the valve means 31 is closed. Subsequently, the valve 19 is opened, so that via the then existing connection between the interior of the bottle 11 and the residual gas chamber 17 a residual pressure relief is effected, and in particular via a slight overpressure, for example approximately 0.5 bar, that is set or adjusted in the residual gas chamber 17.

As an alternative to the described embodiment, which pertains to a controlled four-chamber short tube filling system, also conceivable is, for example, an embodiment in the form of a controlled three-chamber short tube filling system, whereby the residual gas chamber 17 would be eliminated and the pressure-relief channel 16 would then, preferably via a nozzle means, be directly opened to the atmosphere. Furthermore, instead of the valve means 19 with the actuating means 18, a valve such as a plunger valve could also be provided, with such a valve cooperating with external control elements or cams of the filling machine that do not rotate along with the rotor portion 2.

The method of operation with the previously described process steps that are possible with the inventive configuration also has the particular advantage of an extremely low consumption of $CO_2$, since the return gas that is displaced out of the pre pressurized bottle 11 during the filling process flows completely back into the pre pressure-relief chamber 29 or into the pressurized gas chamber 30, so that this return gas, which consists almost entirely of $CO_2$, can again be utilized during the subsequent filling phases for preliminary rinsing, partial pressurization, and residual pressurization of a respective bottle 11.

Figure 2:
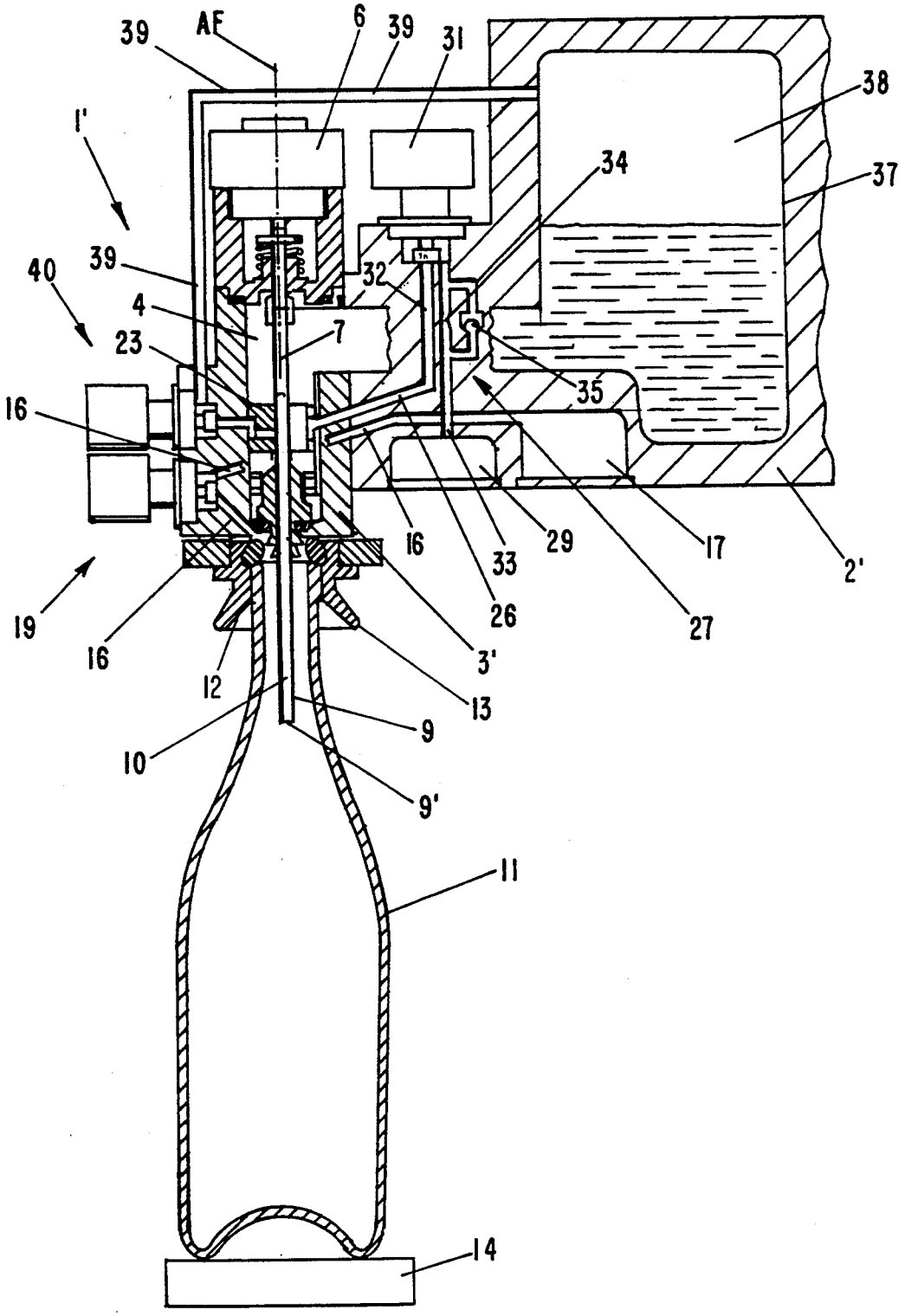
FIG. 2 is a view similar to FIG. 1 of a second exemplary embodiment of the present invention.

FIG. 2 illustrates an embodiment that first of all differs from the embodiment of FIG. 1 in that instead of the annular chamber 22, an annular tank 37 is formed on the rotor portion 2'. The annular tank 37 is filled with the liquid filling material only to a prescribed level, whereby a space 38 is formed over the liquid filling material for pressurizing gas or $CO_2$ gas that is at filling pressure. The embodiment of FIG. 2 also differs from the embodiment of FIG. 1 in that only the controlled gas path 27 is provided, and in that instead of the gas path 28 a gas channel 39 is provided that on the one hand opens out into the space 38 above the level of the liquid filling material, and on the other hand communicates with the annular gas channel provided in the tubular member 9, and in particular again via the distribution means 23. Provided in the channel 39 is a control valve means 40 that is embodied in the same manner as the control valve means 19 and, like the control valve means 19, projects radially from the outer side of the filling element 1', i.e. from the housing 3'.

With the controlled three-chamber short tube filling system illustrated in FIG. 2, in principle the same process steps are possible as were described in conjunction with the filling system of FIG. 1, whereby with the embodiment of FIG. 2, the valve means 40 and the pertaining channel 39 assume the functions of the valve means 36 and the gas path 28.

Those elements of the embodiment of FIG. 2 that correspond in configuration and function to those of the embodiment of FIG. 1 have the same reference numerals as do the corresponding elements of FIG. 1.

The present invention has been described in conjunction with specific embodiments. It is to be understood that alterations and modifications are possible without thereby straying from the inventive concept. For example, with the illustrated embodiment the gas paths 27 and 28, and in that connection in particular the control valve means 31 and 36 as well as the parallel arrangement of the nozzle means 34 and the check valve 35, have been respectively provided on the rotor portion 2 or 2'. In principle, it is also possible to at least partially provide these gas paths in the housing 3 or 3' of the filling element 1 or 1', and in so doing to provide, for example, the control valve means 31 and 36 and/or the parallel arrangement of the nozzle means 34 and of the check valve in or on the housing 3 or 3'.

The present invention is, of course, in no way restricted to the specific disclosure of the specification and drawings, but also encompasses any modifications within the scope of the appended claims.

What I claim is:

1. An arrangement for filling bottles or similar containers with a liquid filling material under counterpressure, comprising:

at least one filling element defining a liquid flow path having a controlled liquid flow valve therein for filling a container with liquid, said filling element including seal means whereby during a filling process said container is sealingly engaged;

at least one gas channel connected to a gas chamber means that communicates with an interior of said container for supplying gas thereto in a controlled manner from said gas chamber means, and for withdrawing to said gas chamber means return gas that is displaced from said container during a filling process; and said gas channel having at least one gas path disposed therein, said at least one gas path having first channel portion provided, in a series arrangement, with means for determining an effective flow cross-section thereof in response to direction of gas flow therein, and with an individually activatable control valve means, whereby said means for determining an effective flow cross-section automatically controls said flow cross-section such that for said return gas, which flows through said gas path in a first direction, said flow cross-section is smaller than for said gas, which flows through said gas path in a second, opposite direction.

2. An arrangement according to claim 1, wherein said means for determining the effective flow cross-section comprises a parallel arrangement of at least one nozzle means and one check valve that opens in said second flow direction, with said parallel arrangement being disposed in series with said control valve means.

3. An arrangement according to claim 2, wherein said check valve is disposed in a vertically extending portion of said first channel portion of said at least one gas channel.

4. An arrangement according to claim 1, wherein in said at least one gas path said means for determining the effective flow cross-section is downstream of said control valve means in said first flow direction.

5. An arrangement according to claim 1, wherein said at least one gas path has a second channel portion that opens into or is a part of said gas channel, with said first channel portion communicating with said chamber means.

6. An arrangement according to claim 1, wherein said chamber means includes at least one chamber that is a pre pressure-relief or return gas chamber.

7. An arrangement according to claim 1, wherein said chamber means includes at least one chamber that is a pressurized gas chamber.

8. An arrangement according to claim 1, wherein said chamber means is a space that is filled with pressurized gas and is in a tank of a filling system, said tank being filled only partially with said liquid filling material.

9. An arrangement according to claim 1, wherein two gas paths are provided, each of which in turn is provided with a respective means for automatically controlling the flow cross-section, with each of said gas paths being connected to a respective chamber means.

10. An arrangement according to claim 9, wherein one of said chamber means is a pre pressure-relief or return gas chamber that is connected to a first one of said gas paths, and the other of said chamber means is a pressurized gas chamber that is connected to a second one of said gas paths.

11. An arrangement according to claim 1, wherein said filling element, rather than having a filling tube, has a tubular member that forms a return gas tube with an opening that allows said at least one gas channel to communicate with said interior of said container.

12. An arrangement according to claim 1, wherein said individually activatable control valve means is an electrically or pneumatically activatable valve.

13. An arrangement according to claim 1, wherein said at least one gas path comprises two channel portions between which is interposed said control valve means, which comprises a valve body disposed in an outwardly closed valve chamber with which said channel portions communicate via respective opening means, about one of which is provided a valve seating surface for said valve body.

14. An arrangement according to claim 1, wherein in addition to said at least one gas path, a further gas path is provided that has an individually activatable control valve means and leads to a chamber for pressurized gas, said further gas path having no means for automatically controlling a flow cross-section thereof.

15. An arrangement according to claim 1, wherein a pressure-relief channel that has a control valve is provided and communicates with the interior of said container.

16. An arrangement according to claim 15, wherein said pressure-relief channel communicates with a residual gas chamber or is open to the atmosphere.

17. An arrangement according to claim 15, wherein said control valve of said pressure relief channel is an individually controllable control valve.

18. An arrangement according to claim 1, wherein all of said control valve means have the same construction.

19. An arrangement according to claim 1, wherein said filling element includes a housing that accommodates at least one of said control valve means and said means for automatically controlling the effective flow cross-section.

20. An arrangement according to claim 1, wherein a plurality of said filling elements are provided on a support member of a filling machine, with at least one of said control valve means and said means for automatically controlling the effective flow cross-section being provided in or on said support member.

* * * * *

UNITED STATES PATENT AND TRADEMARK OFFICE

CERTIFICATE OF CORRECTION

PATENT NO. : 5,377,726

DATED : Jan. 3, 1995

INVENTOR(S) : Clüsserath

It is certified that error appears in the above-indentified patent and that said Letters Patent is hereby corrected as shown below:

On the title page item [73], should read:

-- KHS Maschinen- und Anlagenbau Aktiengesellschaft, Dortmund, Germany --.

Signed and Sealed this

Twenty-fifth Day of June, 1996.

*Attest:*

BRUCE LEHMAN

*Attesting Officer*

*Commissioner of Patents and Trademarks*